United States Patent [19]

Brook

[11] 4,133,098

[45] Jan. 9, 1979

[54] APPARATUS FOR SORTING SUCCESSIVE ARTICLES MOVING ALONG A PATH

[75] Inventor: Richard M. Brook, Huddersfield, England

[73] Assignee: AutoSystems Limited, Yorkshire, England

[21] Appl. No.: 797,963

[22] Filed: May 18, 1977

[51] Int. Cl.[2] ..... B07C 5/00

[52] U.S. Cl. ..... 209/565; 209/655; 198/569

[58] Field of Search ..... 209/74 R, 74 M, 121; 198/569

[56] References Cited

U.S. PATENT DOCUMENTS

| | | | |
|---|---|---|---|
| 2,098,260 | 11/1937 | Smith | 209/121 |
| 2,961,096 | 11/1960 | Hecox et al. | 209/121 |
| 2,962,165 | 11/1960 | Aller et al. | 209/82 |
| 3,344,596 | 3/1944 | Carmina | 209/88 |

*Primary Examiner*—Allen N. Knowles
*Attorney, Agent, or Firm*—John C. Smith, Jr.

[57] ABSTRACT

Apparatus for use in sorting a succession of articles which are moving along a path, the apparatus comprising: a plurality of receiving devices arrangeable to move adjacent to the succession of articles travelling along the path, so that over at least a part of the path each article moves in unison with one of the receiving devices; means for transferring each article to a receiving device as it moves in unison with the article, and a plurality of delivery stations past which the receiving devices travel, each receiving device being operable to feed an article which it has received to any one of the delivery stations as the receiving device passes the delivery station.

11 Claims, 2 Drawing Figures

APPARATUS FOR SORTING SUCCESSIVE ARTICLES MOVING ALONG A PATH

BACKGROUND TO THE INVENTION

The invention relates to sorting apparatus, and particularly but not exclusively to apparatus for sorting poultry carcasses.

DESCRIPTION OF THE PRIOR ART

Apparatus for sorting poultry carcasses is known, for example in U.S. Pat. No. 3,997,013, in which poultry carcasses are conveyed along a path suspended by their legs from special shackles running along an overhead rail. When a carcass reaches a receiving bin appropriate for the particular size or grade of carcass a mechanism placed over that bin actuates the appropriate shackle to release the carcass, thereby allowing the carcass to fall into the bin. Such special shackles are for example disclosed in U.S. Pat. No. 3,291,303. A plurality of receiving bins are spaced apart along the path and a shackle actuating mechanism is placed over each bin. The shackle actuating mechanisms are readily selectively operable in response to signals received from control apparatus.

On some types of poultry processing line however, it is inconvenient or impossible to use these special shackles, which means that carcasses cannot be selectively released at a plurality of poimts. It is only possible to use a removal device which removes all the carcasses at a single point. For example a saw may be used which cuts through the legs of each carcass thus freeing the carcass. Alternatively there may be other conditions in a plant which make it necessary to remove all the carcasses at a single point. In such conditions it has hitherto been impossible to sort the carcasses automatically as they are removed.

OBJECT OF THE INVENTION

It is the object of the invention to overcome the disadvantages of the prior art devices and enable articles, particularly poultry carcasses, to be sorted automatically even when they must all be removed at the same point from a path along which they are travelling.

SUMMARY OF THE INVENTION

The invention provides sorting apparatus comprising a plurality of receiving devices arrangeable to move adjacent to a succession of articles travelling along a path, so that over at least part of the path each article moves in unison with one of the receiving devices, means for transferring each article to a receiving device moving in unison with the article, and a plurality of delivery stations past which the receiving devices travel, each receiving device being operable to feed an article which it has received to any one of the delivery stations as the receiving device passes the delivery station.

Each delivery station may comprise a delivery chute and each receiving device may comprise a container capable of receiving an article and having means for releasing the article into any one of the chutes.

Each container may comprise a hopper having a counterbalance which retains the hopper in an upright position but permits the hopper to tip over when it is loaded with an article, the hopper having catch means to prevent the loaded hopper from tipping over until the catch means is released.

The chutes may be spaced apart around the periphery of a circle, the containers being spaced apart around the periphery of a wheel which is mounted for rotation above the chutes. The wheel may be arranged to be driven by a conveyor travelling along a path above the wheel. The wheel may be coupled to a further wheel lying above the first wheel so that the conveyor may be arranged to pass around the further wheel to drive the wheel.

The invention includes a method of sorting articles which are travelling in succession along a path, comprising transferring each article to one of a plurality of receiving devices each moving in unison with one of the articles over at least part of the path, and causing the receiving device to feed the article which it has received to any one of a plurality of delivery stations.

DESCRIPTION OF AN EMBODIMENT OF THE INVENTION

Figure 1:
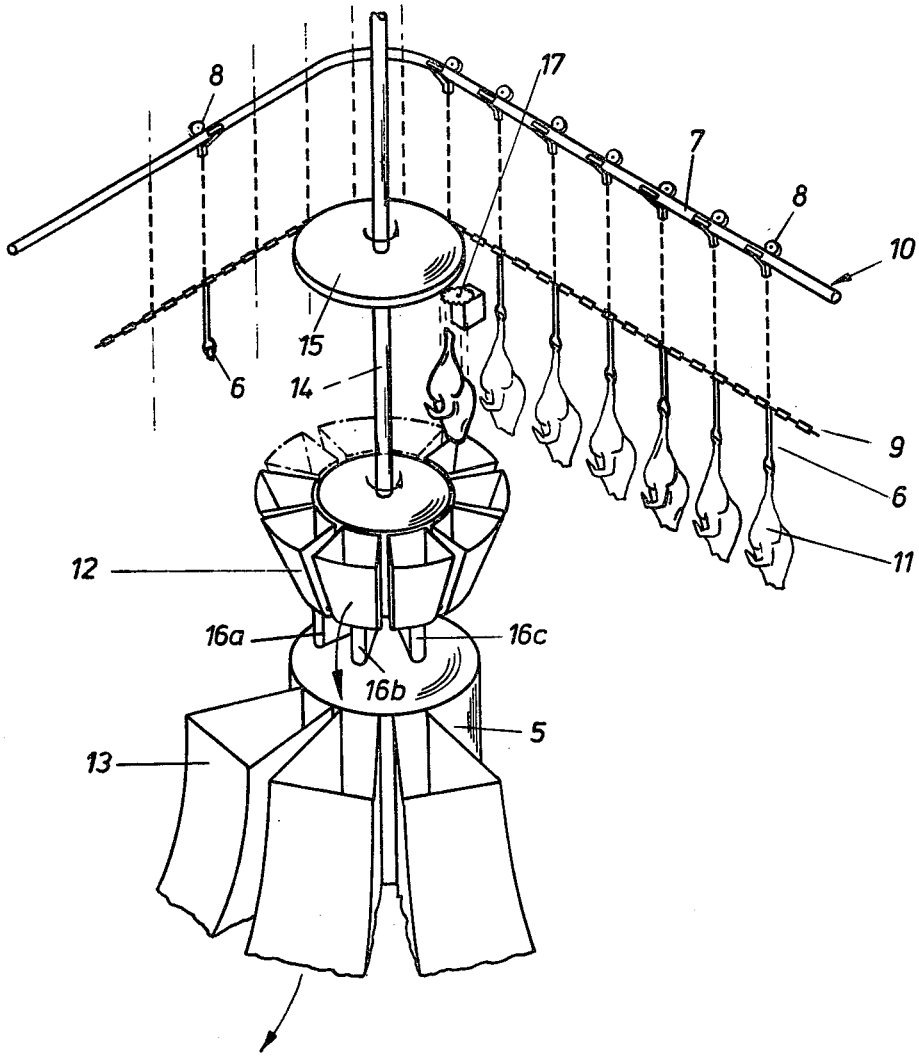
FIG. 1 is a perspective view of an embodiment of apparatus according to the invention.

The apparatus which forms the subject of this example is particularly applicable to the sorting of poultry carcasses and FIG. 1 illustrates diagramatically part of an overhead conveyor 10 carrying a succession of poultry carcasses 11. The conveyor comprises an overhead rail 7 along which a series of spaced apart wheeled trolleys 8 are drawn by a chain 9. The legs of each carcass 11 are hooked into simple shackles 6, one shackle being suspended from each trolley 8.

Poultry carcass sorting systems are known in which special shackles are suspended from an overhead conveyor. Carcasses are hung on the shackles and when a carcass reaches a receiving bin appropriate for the particular size or grade of carcass a mechanism placed over that bin actuates the appropriate shackle and allows the carcass to fall into the bin. On some types of poultry processing line however it is inconvenient or even impossible to use these special shackles, and all the carcasses must be removed at a single point. The apparatus forming the subject of this example enables carcasses to be sorted, even with conveyor systems where special shackles cannot be used.

The apparatus comprises principally a set of rotating hoppers 12 and a set of stationary delivery chutes 13. The hoppers 12 are mounted on a 19 inch diameter wheel and there are ten hoppers spaced apart around the periphery of the wheel, the centres of adjacent hoppers being 6 inches apart. The wheel is mounted on a vertical shaft 14 and a further wheel 15 is secured to the shaft above the first wheel. The chain 9 of the conveyor 10 passes around the wheel 15 to drive the wheel, so that the hoppers 12 rotate as the carcasses 11 move along the conveyor path. The carcasses are also spaced 6 inches apart and the arrangement is such that over that part of the path for which the conveyor passes around the wheel 15, each carcass 11 moves in unison with a hopper 12 positioned immediately beneath the carcass.

There are three delivery chutes 13, and these are spaced apart around the periphery of a circular support 5 below the hoppers 12. The pitch of the spacing is the same as for the hoppers.

Each hopper is counterbalanced into the upright position shown but the hopper is pivoted at its lower end and when the hopper is loaded with a chicken carcass the counterbalance is overcome and the hopper tends to tip outwardly of the wheel carrying the hoppers. However each hopper is locked in the upper position by a catch which is not visible in the drawings.

Mounted respectively above the delivery chutes 13 are three stationary air cylinders 16*a*, 16*b*, and 16*c* each of which is operable to release the catch of a hopper as the hopper passes over the associated chute. Positioned at a point where the chain 9 first makes contact with the wheel 15 there is a saw 17.

As each carcass 11 reaches the saw 17, the legs of the carcass are sawn through and the carcass drops into an empty hopper which at that point in time is moving in unison with the carcass. The carcass travels round in the hopper and when the hopper reaches a delivery chute 13 which is associated with the particular weight, grade or other property of that carcass, the appropriate air cylinder 16 is operated to release the catch on the hopper and the hopper tips over to drop the carcass into the appropriate chute. The countebalanced hopper then returns to its upright position and the catch re-engages.

Figure 2:
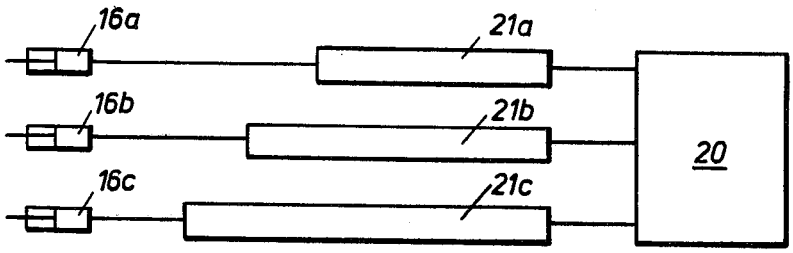
FIG. 2 is a schematic illustration of a control system for the apparatus shown in FIG. 1.

Referring now to FIG. 2, any known weighing and-/or grading apparatus 20 may be utilised to generate a signal related to the weight and/or grade of each carcass, at a weighing and/or grading station upstream of the apparatus shown in FIG. 1. The apparatus 20 may for example be as described in U.S. Pat. No. 4,021,336 or U.S. Pat. No. 4,096,950. The apparatus shown in FIG. 1 is intended to sort the carcasses into one of three groups, each group being associated with one of the chutes 13. The apparatus 20, on receipt of information from a carcass as to its weight and/or grade, allocates that carcass to one of the groups, and actuates the appropriate air cylinder 16*a*, 16*b* or 16*c*. However the cylinder must not be actuated until the relevant carcass has travelled downstream from the weighing and/or grading station, has been transferred into a hopper, and is positioned above the appropriate chute 13. To bring about the necessary delay shift registers 21*a*, 21*b* and 21*c* are connected to the apparatus 20. The three shift registers are connected respectively to each of the three air cylinders 16*a*, 16*b* and 16*c*. Each shift register has a number of sections which is equal to the number of article positions, including positions on the set of hoppers 12, lying between the weighing and/or grading station and the associated chute. Since the chute below cylinder 16*b* is a position further on than that below cylinder 16*a*, shift register 21*b* has one more section than shift register 21*c*. Similarly shift register 21*c* has one more section than shift register 21*b*.

Thus when each carcass has been analysed at the weighing and/or grading station and has been allocated to the desired sorting group, a signal is fed into whichever of the three shift registers is associated with that group. The carcass then moves on downstream and the signal moves through the shift register in synchronisation with the movement of the article. When the article is positioned above the correct chute the signal emerges from the shift register and causes the relevant air cylinder to release the hopper and drop the carcass into the correct chute.

The invention is not restricted to the details of the foregoing example. For instance it is not essential for there to be three chutes 13. There may be as many chutes arranged around the support 5 as there are different categories of carcass to be sorted, with an appropriate receiving bin arranged underneath each chute. The size of apparatus shown can accomodate up to ten chutes but the size of the apparatus may be increased if necessary.

The hoppers and chutes need not necessarily be arranged on a circle. They may be arranged along some other curved part of the conveyor path, or indeed along a straight part of the conveyor. For instance the hoppers may be arranged on an endless chain or belt conveyor one run of which coincides with part of the path of the main conveyor 10.

The saw for releasing each carcass from the conveyor may be replaced by some other form of unloading device arranged to free each carcass from the conveyor. For instance known forms of wedge or belt type unloading device may be used.

While the apparatus and method according to the invention have been specifically developed for use in poultry processing, it will be appreciated that the apparatus and method can be used with advantage in any process where articles moving along a path must be removed at a point in the path and then sorted.

I claim:

1. Apparatus for use in sorting a succession of articles which are moving along a path, the apparatus comprising:

(a) a plurality of receiving devices arranged to move adjacent to the succession of articles traveling along the path, so that along at least a part of the path each article moves in unison with one of the receiving devices;

(b) means for transferring each article to a receiving device as it moves in unison with the article;

(c) a plurality of delivery stations past which the receiving devices travel; and (d) a plurality of release devices, one associated with each of the delivery stations, the release devices being selectively operable to release an article at any desired delivery station when the article is carried past the delivery station by a receiving device.

2. Apparatus as claimed in claim 1, in which each delivery station comprises a delivery chute.

3. Apparatus as claimed in claim 1, in which each receiving device comprises a container capable of receiving an article and having means operable by a release device to release the article at any one of the delivery stations.

4. Apparatus as claimed in claim 3, in which each container comprises a hopper having a counterbalance which retains the hopper in an upright position but permits the hopper to tip over when it is loaded with an article, the hopper having catch means to prevent the loaded hopper from tipping over until the catch means is released by a release device.

5. Apparatus as claimed in claim 3 in which the delivery stations are spaced apart around the periphery of a circle, the containers being spaced apart around the periphery of a wheel which is mounted for rotation above the delivery stations.

6. Apparatus as claimed in claim 5, in which the wheel is arranged to be driven by a conveyor travelling along a path above the wheel.

7. Apparatus as claimed in claim 6 in which the wheel is coupled to a further wheel lying above the first wheel so that the conveyor may be arranged to pass around the further wheel to drive the wheel.

8. Apparatus as claimed in claim 1 in combination with control means for monitoring articles upstream of the receiving devices and supplying a succession of signals, each signal being related to a property of one of the articles, and delay means connected between said control means and each of said release devices to transfer signals from said control means to said release devices, the delay means providing a delay related to the movement of the articles, so that each article is released at a delivery station associated with the property of that article.

9. Apparatus as claimed in claim 8, in which the delay means comprises a plurality of shift registers, each shift register being connected to one of the release devices and the shift registers having different lengths.

10. A conveyor system for conveying a succession of articles along a path, removing said articles from the path, and sorting said articles, the system comprising:

(a) a continuous conveyor moving along a first path, the articles being located on the conveyor at spaced-apart points along the length thereof;

(b) a plurality of delivery stations successively arranged along a second path and to which the articles are to be selectively delivered thereby sorting the articles;

(c) a plurality of article receiving devices;

(d) means to move the plurality of article receiving devices successively along a route which lies adjacent to at least part of said first path and along said second path successively past said delivery stations;

(e) means coupling the conveyor to said means to move the plurality of article receiving devices so that the article receiving devices move in unison with the articles along at least part of said first path;

(f) means for transferring each article from the conveyor to a receiving device as the device moves in unison with the article; and (g) means to selectively transfer each article from a receiving device to any one of the delivery stations as the device moves past the delivery station.

11. Apparatus for use in sorting a succession of articles which are moving along a first path, the apparatus comprising:

(a) a plurality of receiving devices arranged to move in succession along a second path adjacent to said succession of articles traveling along said first path, so that along at least a part of said first and second paths each article moves in the same direction and in unison with one of said receiving devices;

(b) means for transferring each article to a receiving device as it moves in unison with said article; and (c) a plurality of delivery stations arranged in succession adjacent at least a part of said second path such that each of said receiving devices while moving along said second path successively passes said delivery stations, each receiving device being adapted to feed an article which it has received to any one of said delivery stations as said receiving device passes said delivery stations.

* * * * *